US005375814A

United States Patent [19]

Marjama

[11] Patent Number: 5,375,814

[45] Date of Patent: Dec. 27, 1994

[54] DIRECT LIFT JACK WITH LOW PROFILE

[76] Inventor: Gary Marjama, 19521 W. Oakmont Dr., Hialeah, Fla. 33014

[21] Appl. No.: 108,239

[22] Filed: Aug. 19, 1993

[51] Int. Cl.[5] ..... B66F 3/00

[52] U.S. Cl. ..... 254/124

[58] Field of Search ..... 254/8 R, 8 B, 8 C, 124, 254/88, 9 R, 9 B, 9 C, 10 R, 10 B, 10 C, 7 R, 7 B, 7 C

[56] References Cited

U.S. PATENT DOCUMENTS

| | | | |
|---|---|---|---|
| 2,166,477 | 7/1939 | Polk et al. | 254/88 |
| 2,361,690 | 10/1944 | Hunz | 254/124 |
| 4,461,456 | 7/1984 | Munna | 254/88 |
| 4,486,006 | 12/1984 | Fawdry | 254/88 |
| 4,641,813 | 2/1987 | Arzouman | 254/8 B |
| 4,690,378 | 9/1987 | Jarman et al. | 254/8 B |
| 5,065,983 | 11/1991 | Slay | 254/8 B |

FOREIGN PATENT DOCUMENTS

| | | | |
|---|---|---|---|
| 2429742 | 6/1978 | France | 254/8 B |

*Primary Examiner*—Robert C. Watson
*Attorney, Agent, or Firm*—R. J. Van Der Wall

[57] ABSTRACT

A jack apparatus for lifting an object along a substantially vertical path includes a base structure including a guide structure and an axle, a first member having a first end and a second end and a midsection, and constrained at the first end to slide along the guide structure and adapted at the second end to engage the object, the first member having a certain length, a second member pivotally connected to the midsection of the first member and extending a distance substantially half the certain length to pivotally connect to the axle, a drive mechanism for propelling the first end of the first member along the guide mechanism toward the axle to swing the first member progressively toward a vertical position, thereby lifting the object engaged at the second end of the first member. The drive mechanism is preferably a hydraulic cylinder. A housing is preferably provided around the cylinder, the housing having guide slots functioning as the guide structure through which the first member connects to the cylinder. The first member preferably includes two elongate side members and a connecting cross-member. The second end of the first member preferably includes a cross-bar for engaging the object to be lifted. The second member preferably includes two elongate side members and a connecting member.

23 Claims, 5 Drawing Sheets

DIRECT LIFT JACK WITH LOW PROFILE

BACKGROUND OF THE INVENTION

1. Field of the Invention:

The present invention relates generally to the field of jacks for lifting vehicles, and more specifically to a low profile jack which can lift a vehicle along a substantially vertical line, including a base frame having a base axle at a first end and a housing containing a hydraulic cylinder at a second end, a lift fork pivotally connected at a first end to the hydraulic cylinder through horizontal guide slots in the housing and having a cross bar at a second end to engage part of a vehicle to be lifted, a fulcrum fork half the length of the lift fork, pivotally connected at its first end to the base axle and at its second end to a lift axle extending laterally through the midsection of the lift fork, such that hydraulic pressure within the cylinder can push the first end of the lift fork along the guide slots and toward the first end of the fulcrum fork, thereby pivoting the lift fork so that its second end, together with the vehicle, move to a progressively higher position, the jack also including a brace fork for securing the lift fork second end at a certain elevation, the brace fork pivoting at a first end on the base axle so that the brace fork second end swings underneath the lift fork cross bar, and the lift fork can be lowered slightly to rest against retaining plates on the brace fork.

2. Description of the Prior Art:

There have long been jacks for lifting vehicles to execute repairs. Some of these have been bumper jacks which typically include a vertical rack member slid down into an opening in a base plate, and a rachet mechanism and lever for raising and lowering an attached bumper-engaging bracket. A problem with these jacks is that they tend to be unstable. A lateral force on the vehicle can cause the jack to tip over so that the vehicle falls, leading to crippling and sometimes fatal injuries. Assembly and disassembly of the bumper jack is typically a required inconvenience. Another common type of vehicle jack is the hydraulic floor jack. A horizontal hydraulic housing has a pump lever and a lift arm both pivoting from one end of the housing. A problem with this type of floor jack is that the arm rises along an arc, moving the vehicle or the jack horizontally during lifting. This movement creates dangerous instability and can cause harmful lateral loading on wheels supporting the elevated vehicle. Another problem is that the hydraulic housing must extend under the vehicle during use, but may not be low enough fit under some vehicles. Other jack variations have included the following.

Hunz, U.S. Pat. No. 2,361,690, issued on Oct. 31, 1944, discloses a jack for engaging and lifting part of a vehicle. A rachet carriage including a pawl and lever rides on a horizontal bar having teeth along its upper edge. A first linkage is pivotally connected to the carriage and to a vehicle engaging bracket. A pair of second linkages is pivotally connected to either side of the first linkage and to a base plate joined to an end of the horizontal bar. The carriage ratchets the lower end of the first linkage toward the lower ends of the second linkages, thereby progressively pivoting the first and second linkages into more vertical positions. This action in turn lifts the engaging bracket and vehicle. A reverse ratcheting action gradually lowers the bracket and vehicle. A problem with Hunz is that the relative geometric proportions of the first and second linkages and their connecting points do not create direct vertical lift. There is a dangerous and superfluous horizontal component of the lifting and lowering movements, similar to that described above for floor jacks.

Everson, U.S. Pat. No. 3,671,013, issued on Jun. 20, 1972, teaches a jack adapted for use in elevating the wings of a sail plane to support the plane during hanger storage. The structure includes two horizontal, parallel racks forming part of a base frame, and two arm members. An end of an arm member is pivotally connected to an end of each rack, and the other end of each arm member is joined to a contoured wing engaging plate. A pinion connected to one end of a lever member rides on each rack. The other end of the lever member pivotally connects to an arm. A winch mechanism drives the pinions along the racks to pivot the lever members and the arm members either upward or downward. The relative proportions of the Everson lever members, the arm members and the distances between pivot points bring about a lifting action with a horizontal component, as in Hunz.

Chiesa, U.S. Pat. No. 4,460,158, issued on Jul. 17, 1984, reveals a motorcycle and moped jack, A double arm member lift structure is pivotally connected to a base frame and is hinged upward by the action of a hydraulic cylinder and piston. Since the arm pivots from a translationally fixed fulcrum, the free ends of the arm members swing along an arc. Thus the lifting motion has both horizontal and vertical components.

Johnson, U.S. Pat. No. 3,659,824, issued on May 2, 1972, discloses an airplane jack. The lower ends of two arm members are pivotally mounted or: a horizontal rod. Two hydraulic cylinders are chained a lateral distance cut from the horizontal rod. The piston rods and cylinders are tilted upward to intersect and pivotally join to the upper ends of the arm members. Pumping the cylinders pivots the upper ends of the arm members upward to bear against and lift part of an airplane. Johnson lifts along an arc path just as Chiesa does.

Jarman, U.S. Pat. No. 4,690,378, issued on Sep. 1, 1987, teaches a vehicle jack including a horizontal rail with a lift arm pivotally connected at one end. A hydraulic cylinder at the other end of the rail drives a carriage along the rail. A lever is pivotally connected to the carriage and to the lift arm to pivot the lift arm upward and downward. Again, the lift arm has a translationally fixed fulcrum point and thus swings up and down along an arc, introducing a horizontal component into the lifting action.

It is thus an object of the present invention to provide a jack which is suitable for use in lifting objects and especially vehicles along a substantially vertical line for maximized stability and minimal shifting of the vehicle weight load. The avoidance of substantial horizontal movement during lifting is especially important for lifting race cars, where the load should not be shifted laterally to other wheels.

It is another object of the present invention to provide such a jack which collapses into a very low profile to easily fit under virtually any type of motor vehicle.

It is still another object of the present invention to provide such a jack which is sturdy and reliable.

It is finally an object of the present invention to provide such a jack which is relatively easy and inexpensive to manufacture.

SUMMARY OF THE INVENTION

The present invention accomplishes the above-stated objectives, as well as others, as may be determined by a fair reading and interpretation of the entire specification.

A jack apparatus is provided for lifting an object along a substantially vertical path, including a base structure including a guide structure and an axle, a first member having a first end and a second end and a midsection, and constrained at the first end to slide along the guide structure and adapted at the second end to engage the object, the first member having a certain length, a second member pivotally connected to the midsection of the first member and extending a distance substantially half the certain length to pivotally connect to the axle, a drive mechanism for propelling the first end of the first member along the guide mechanism toward the axle to swing the first member progressively toward a vertical position, thereby lifting the object engaged at the second end of the first member. The drive mechanism is preferably a hydraulic cylinder, but may alternatively be a ratchet and rack assembly. A housing is preferably provided around the cylinder, the housing having guide slots functioning as the guide structure through which the first member connects to the cylinder. The hydraulic cylinder is preferably actuated by an external power source such as a conventional air-over-fluid pump device through a hydraulic hose (not shown). Alternatively, the hydraulic cylinder can be actuated by an electric motor driven hydraulic pump, an air powered hydraulic pump, a manual hydraulic pump, or the like. The first member preferably includes two elongate side members and a connecting cross-member. The second end of the first member preferably includes a cross-bar for engaging the object to be lifted. The cross-bar nay additionally include axial rod portions extending from either end of the cross-bar for engaging apertures in the object. The second member preferably includes two elongate side members and a connecting member. The apparatus also preferably includes a brace member having a first end which is pivotally secured to the base structure and a second end which pivots to a position underneath the first member second end to brace the first member second end in an elevated position. The apparatus also preferably includes cradle plates at the second end of the brace member adapted to retain the cross bar.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 2:
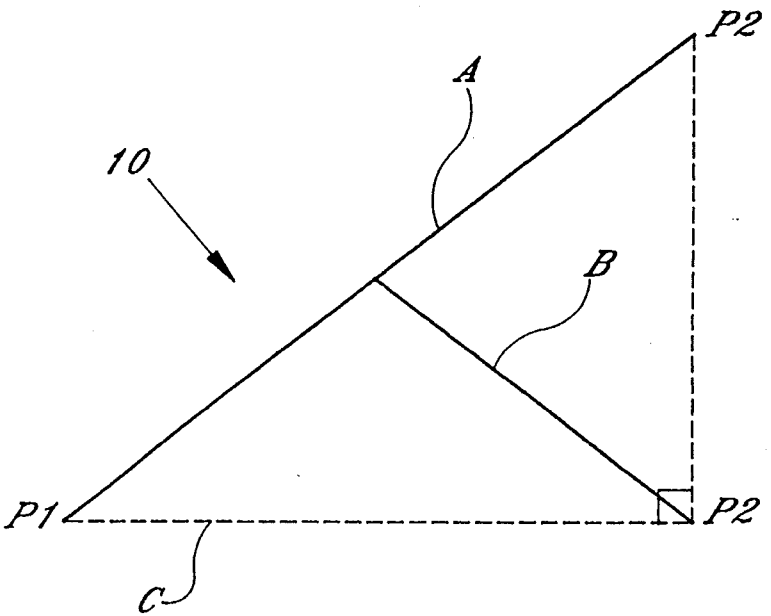
FIGS. 1 and 2 are schematics of the geometric design of the inventive jack apparatus showing that the figure defined by points P1, P2 and P3 remains a right triangle at progressive stages of point P2 elevation.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Figure 1:
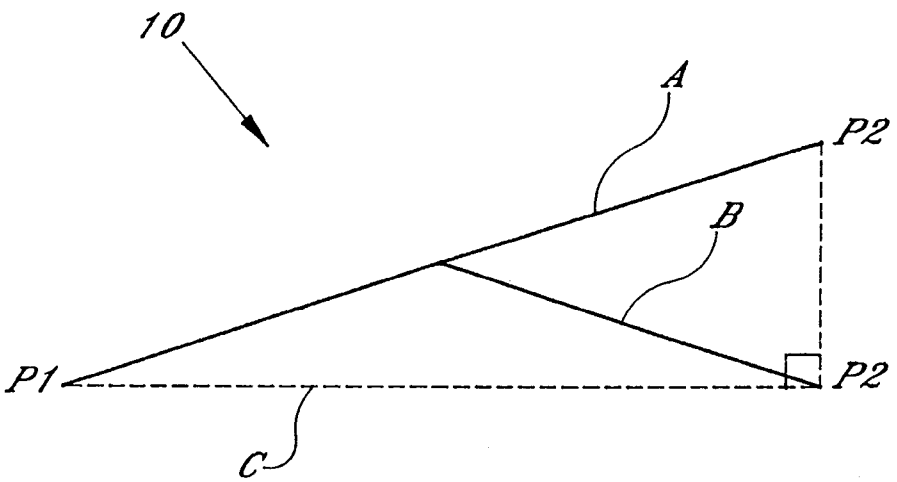
Figure 3:
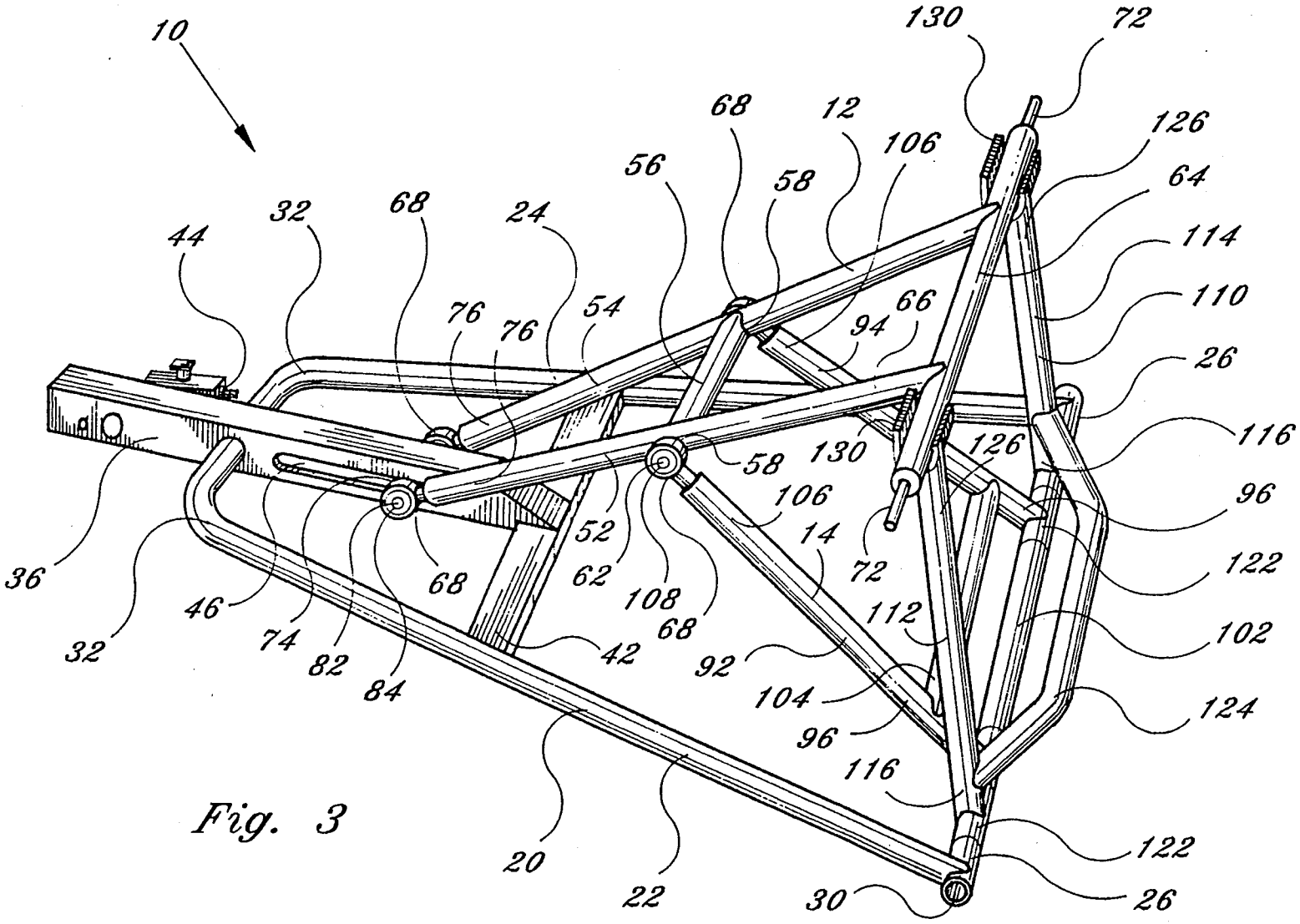
FIG. 3 is a perspective view of the preferred embodiment of the inventive jack apparatus secured by the brace fork in an elevated position.
Figure 4:
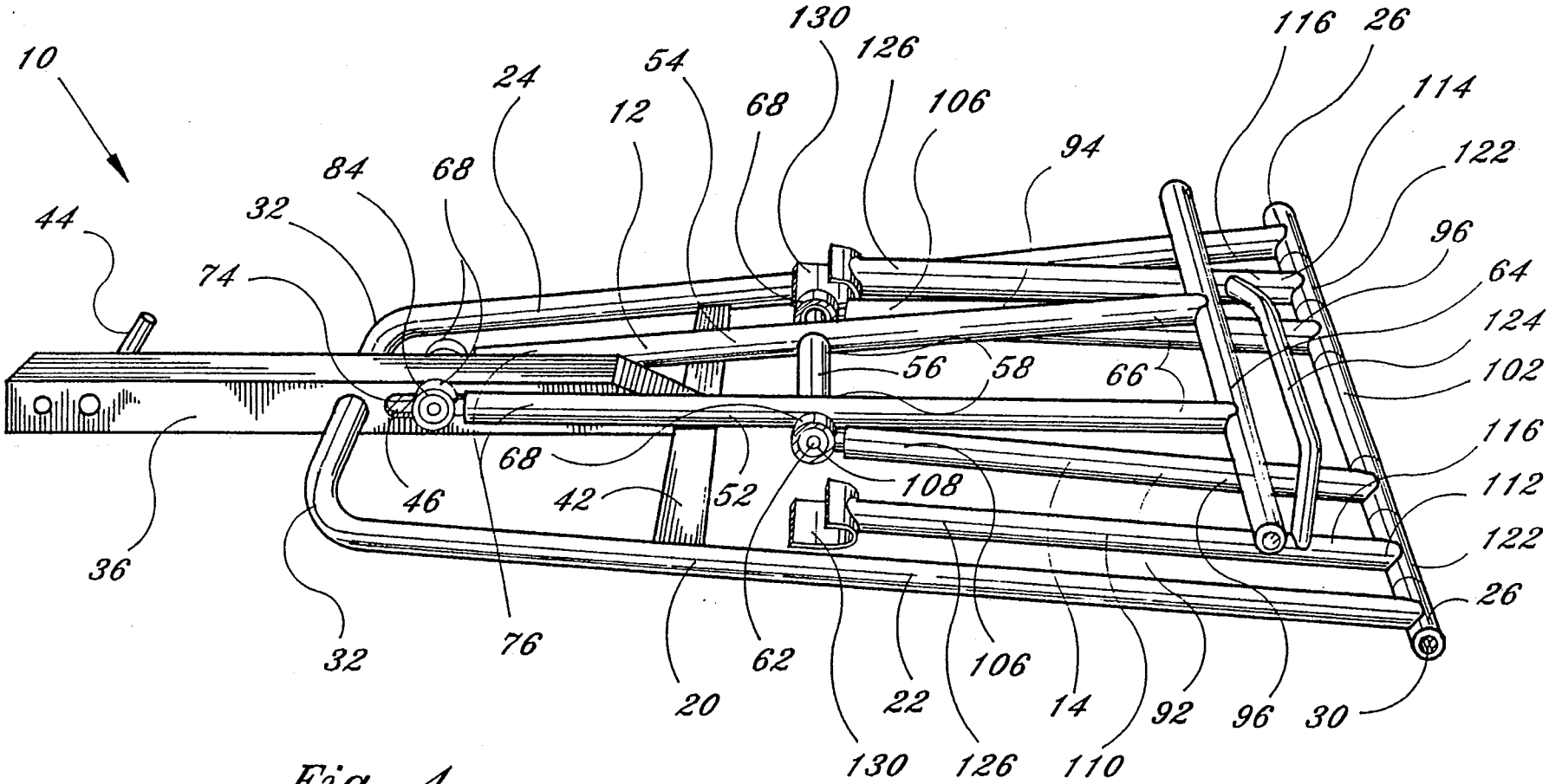
FIG. 4 is a perspective view of the apparatus of FIG. 3 in the collapsed position.
Figure 5:
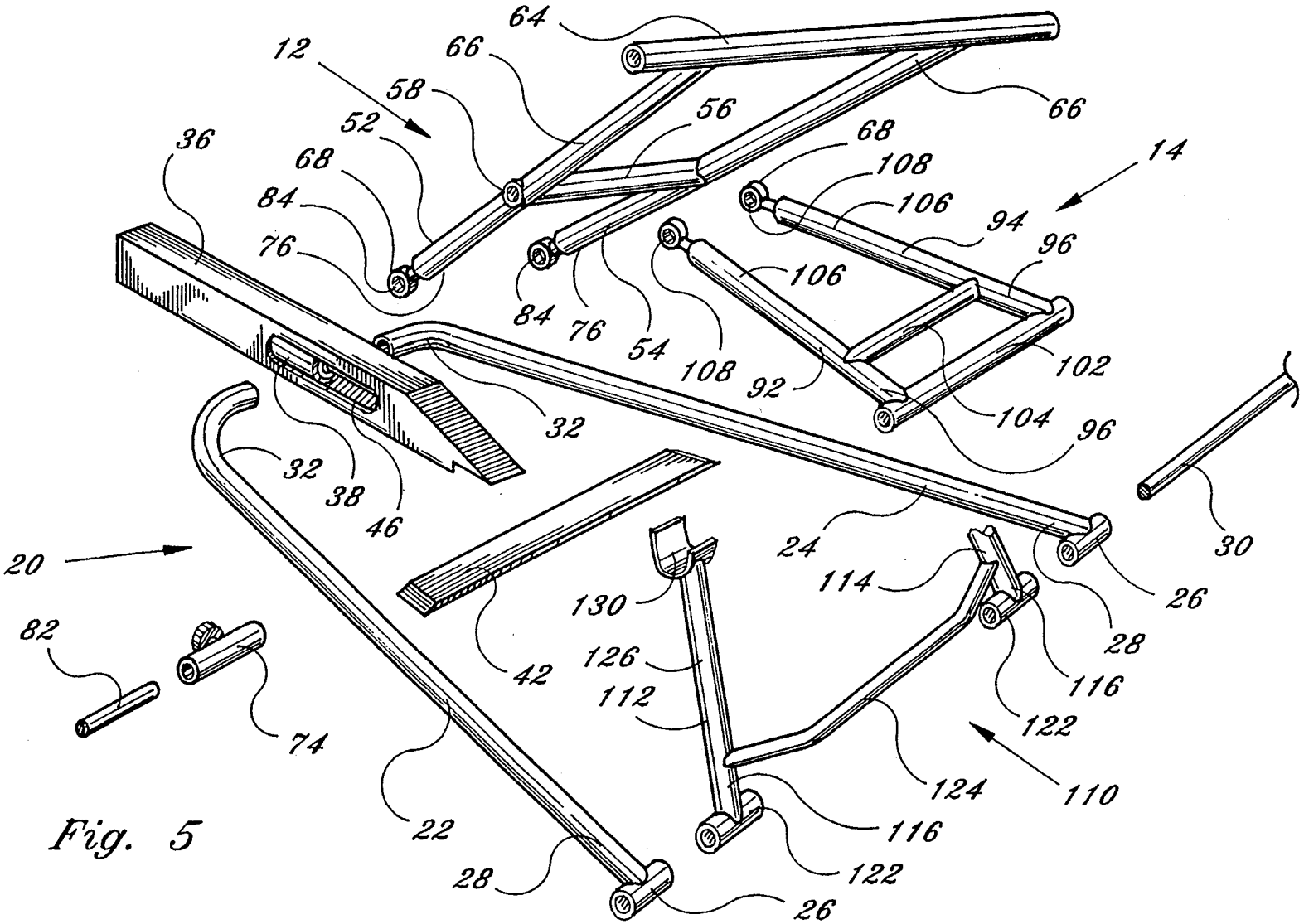
FIG. 5 is an exploded view of the apparatus of FIG. 3.
Figure 6:
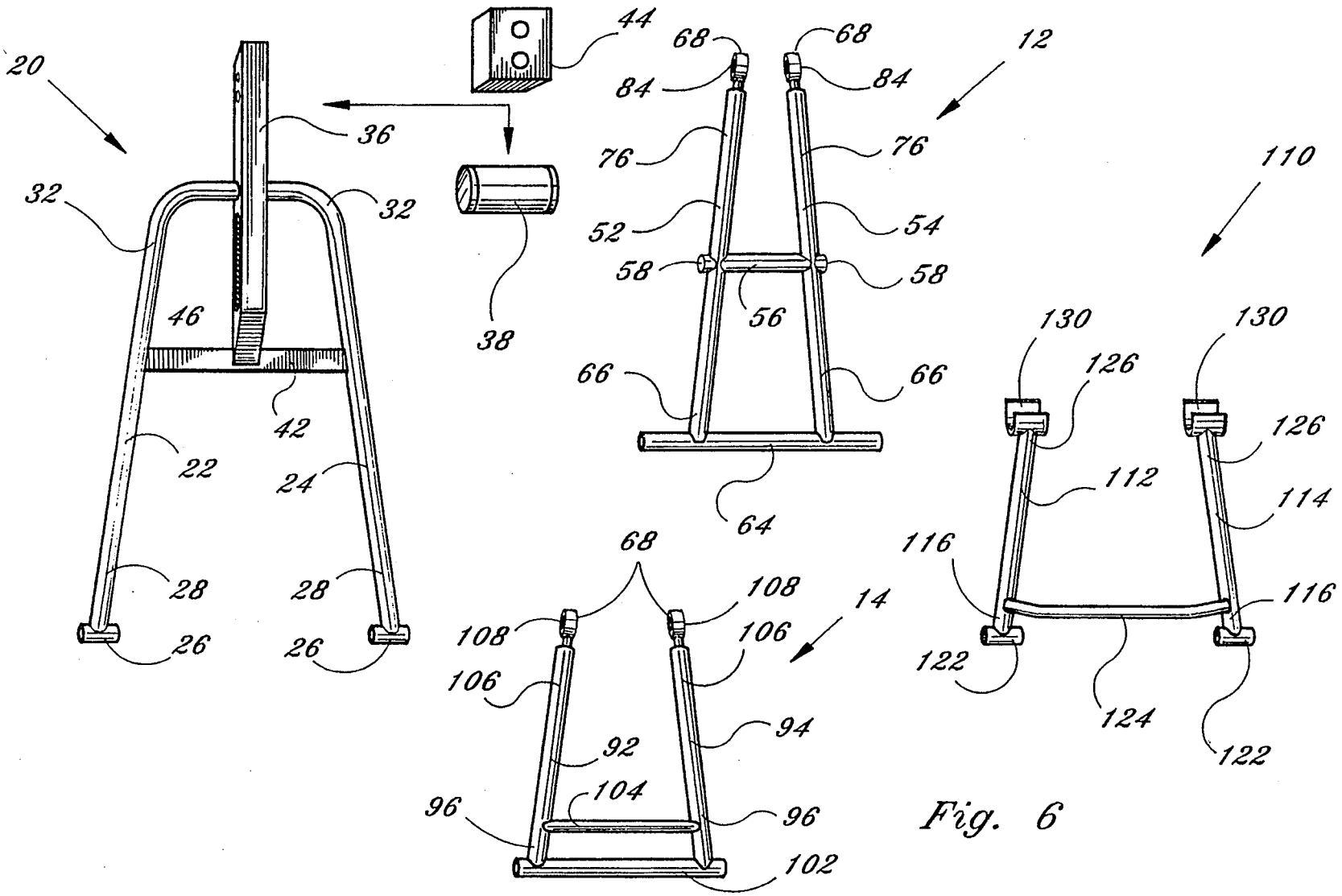
FIG. 6 is a top view of the various separate parts which make up the apparatus of FIG. 3.

Referring to FIGS. 1–6, a jack apparatus 10 is disclosed which can lift an object such as part of a vehicle along a substantially vertical line. Apparatus 10 incorporates a first member A of a given length and a second member B of half the given length pivotally connected at one end to the center of the first member A. See FIGS. 1 and 2. An important characteristic of this structure is that, except when the members A and B are mutually parallel, the two end points P1 and P2 of the first member A and the remote end point P3 of the second member B always define a right triangle. The first member A extends along the hypotenuse. The members A and B are connected to a base C which constrains the remote end point P3 of the second member B to remain translationally fixed and the lower end point P1 of the first member A to slide horizontally only. Since the three end points P1, P2 and P3 always define a right triangle, constraining the lower end point P1 of the first member A to move horizontally also constrains the upper end point P2 to move vertically. While sizes of the invention may be varied, the proportion between the length of the fulcrum fork and the length of the lift fork is fixed in order to achieve substantially vertical linear lifting at end point P2.

Apparatus 10 includes a lift fork 12 corresponding to first member A and a fulcrum fork 14 corresponding to second member B. A base frame 20 corresponding to the above-mentioned base C includes guide means which constrain the movement of the ends of lift fork 12 to directly horizontal and directly vertical paths.

Base frame 20 is also a fork structure including two spaced-apart elongate side members 22 and 24 having lateral axle sleeves 26 attached at their first ends 28 through which a base axle 30 extends. See FIGS. 3–6. Members 22 and 24 converge at their second ends 32 to attach to a housing 36 containing a hydraulic cylinder 38. A cross-strut 42 connects members 22 and 24 and thereby enhances base frame 20 structural integrity. Housing 36 is preferably a tube of square cross-section, as illustrated in the appended FIGURES, and has guide slots 46 along opposing sides. A quick-coupler yoke 44 is provided on cylinder 38 for ready connection to a conventional hydraulic hose.

Lift fork 12 preferably includes two elongate arm members 52 and 54 connected by an axle sleeve 56 extending between the midpoints of members 52 and 54. See FIGS. 3–6. Axle sleeve 56 contains a lift axle 62 protruding outward through holes 58 in arm members 52 and 54. Bushings 68 are preferably provided within holes 58. A cross-bar 64 extends across and connects the second ends 66 of arm members 52 and 54, and preferably has axial rod extensions 72 protruding from each end to engage apertures in a vehicle frame. The first ends 76 of members 52 and 54 converge to abut a T-shaped tube member 74 inside housing 36. A cylinder axle 82 extends rotatably through the tubular top of the T, through guide slots 46, and into holes 84 in the first ends 76 of members 52 and 54. Bushings 68 are also preferably provided within holes 84. The piston rod of cylinder 38 extends into and is affixed within the lower tubular portion of the T in member 74.

Fulcrum fork 14, as indicated in the discussion above, is half the length of lift fork 12. See FIGS. 3–6. Fulcrum fork 14 preferably includes two elongate side members 92 and 94 having first ends 96 joined together by a fulcrum axle sleeve 102. Base axle 30 rotatably extends through fulcrum axle sleeve 102. A fulcrum cross-strut 104 connects members 92 and 94 at opposing points for enhanced structural strength. Lift axle 62 extends through holes 108 in the second ends 106 of members 92 and 94, which are preferably fitted with bushings 68. Should fulcrum fork 14 for some reason be manufactured to extend beyond lift axle 62 and above lift fork 12, the geometric proportions necessary to the vertical linear lift action are not altered. When hydraulic pressure is released in cylinder 38, the first ends 76 and 96 of lift and fulcrum forks 12 and 14, respectively, move apart, and lift and fulcrum forks 12 and 14 pivot down into base frame 20. In this way, apparatus 10 achieves a very low profile to fit easily underneath virtually any part of any motor vehicle.

A brace fork 110 is preferably provided for bracing second ends 66 of lift fork 12 at a pre-selected elevated position. See FIGS. 3–6. Brace fork 110 preferably includes two elongate side members 112 and 114 each having a first end 116 fitted with an axle sleeve 122 pivotally secured around base axle 30. A brace cross-strut 124 connects side members 112 and 114. The second ends 126 of each side member 112 and 114 each preferably include a U-shaped cradle plate 130 for receiving and holding cross-bar 64 of lift fork 12. To use brace fork 110, cross-bar 64 is positioned underneath the part of the vehicle to be lifted. Then hydraulic pressure is pumped into cylinder 38 to raise second ends 66 of lift fork 12 and the part of the vehicle to be lifted to a position above the pre-selected brace elevation. Then brace fork 110 is pivoted so that cradle plates 130 are directly under cross-bar 64. Then hydraulic pressure is released in cylinder 38 to lower cross-bar 64 into cradle plates 130. To disengage brace fork 110, hydraulic pressure is again pumped into cylinder 38 to raise cross-bar 64 out of cradle plates 130. Then brace fork 110 is pivoted back to an essentially horizontal position, preferably within base frame 20.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A jack apparatus for lifting an object using a substantially vertical linear path, comprising:

a base structure comprising guide means and axle means;

a first member having a first end and a second end in a mid-section, and constrained at said first end to slide along said guide means and adapted at said second end to engage said object, said first member having a certain length;

a second member pivotally connected to said mid-section of said first member and extending a distance substantially half said certain length to pivotally connect to said axle means;

drive means for propelling said first end of said first member along said guide means toward said axle means to swing said first member progressively toward a vertical position, thereby lifting said object engaged at said second end of said first member; and a brace member having a first end which is pivotally secured to said base structure and a second end which pivots to a position underneath said first member second end to brace said first member second end in an elevated position.

2. The apparatus of claim 1, wherein said drive means is a hydraulic cylinder.

3. The apparatus of claim 2, wherein said hydraulic cylinder is adapted to be coupled to an external power source through a hydraulic hose.

4. The apparatus of claim 2, wherein a housing is provided around said cylinder, said housing having guide slots functioning as said guide means through which said first member connects to said cylinder.

5. The apparatus of claim 1, wherein said first member comprises two elongate side members and a connecting cross-member.

6. The apparatus of claim 5, wherein said second end of said first member comprises a cross-bar for engaging said object to be lifted.

7. The apparatus of claim 6, wherein said cross-bar additionally comprises axial rod portions extending from either end of said cross-bar for engaging apertures in said object.

8. The apparatus of claim 1, wherein said second member comprises two elongate side members and a connecting member.

9. The apparatus of claim 8 additionally comprising cradle plates at said second end of said brace member adapted to retain said cross-bar.

10. A jack apparatus for lifting an object along a substantially vertical linear path, comprising:

a base structure comprising guide means and axle means;

a first member having a first end and a second end and a midsection, constrained at said first end to slide along said guide means, said second end comprising a cross-bar having axial rod portions extending from either end of said cross-bar for engaging apertures in said object, said first member having a certain length, two elongate side members, and a connecting cross-member;

a second member pivotally connected to said midsection of said first member and extending a distance substantially half said certain length to pivotally connect said axle means; and drive means for propelling said first end of said first member along said guide means toward said axle means to swing said first member progressively toward a vertical position, thereby lifting said object engaged at said second end of said first member.

11. The apparatus of claim 10, wherein said drive means is a hydraulic cylinder.

12. The apparatus of claim 11, wherein a housing is provided around said cylinder, said housing having guide slots functioning as said guide means through which said first member connects to said cylinder.

13. The apparatus of claim 11, wherein said hydraulic cylinder is adapted to be coupled to an external power source through a hydraulic hose.

14. The apparatus of claim 10, wherein second said member comprises to elongate side members and a connecting member.

15. A jack apparatus for lifting an object along a substantially vertical linear path, comprising:

a base structure comprising guide means and axle means;

a first member having a first end and a second end and a midsection, and constrained at said first end to slide along said guide means and adapted at said second end to engage said object, said first member having a certain length;

a second member pivotally connected to said midsection of said first member and extending a distance substantially half said certain length to pivotally connect to said axle means:

drive means for propelling said first end of said first member along said guide means toward said axle means to swing said first member progressively toward a vertical position, thereby lifting said object engaged at said second end of said first member; and a brace member having a first end which is pivotally secured to said base structure and a second end which pivots to a position underneath said first member second end to brace said first member second end in an elevated position.

16. The apparatus of claim 15, additionally comprising cradle plates at said second end of said brace member adapted to retain said cross-bar.

17. The apparatus of claim 15, wherein said drive means is a hydraulic cylinder.

18. The apparatus of claim 17, wherein a housing is provided around said cylinder, said housing having guide slots functioning as said guide means through which said first member connects to said cylinder.

19. The apparatus of claim 17, wherein said hydraulic cylinder is adapted to be coupled to an external power source through a hydraulic hose.

20. The apparatus of claim 15, wherein said first member comprises to elongate side members and a connecting cross-member.

21. The apparatus of claim 20, wherein said second end of said first member comprises a cross-bar for engaging said object to be lifted.

22. The apparatus of claim 21, wherein said cross-bar additionally comprises axial rod portions extending from either end of said cross-bar for engaging apertures in said object.

23. The apparatus of claim 15, wherein said second member comprises two elongate side members and a connecting member.

* * * * *